United States Patent [19]

Bivens et al.

[11] Patent Number: 4,699,321

[45] Date of Patent: Oct. 13, 1987

[54] SPRINKLER HEAD DRAIN VALVE

[75] Inventors: Jon A. Bivens, Upland; Stephen L. Tyler, Diamond Bar, both of Calif.

[73] Assignee: The Toro Company, Minneapolis, Minn.

[21] Appl. No.: 873,122

[22] Filed: Jun. 11, 1986

Related U.S. Application Data

[63] Continuation of Ser. No. 767,664, Aug. 21, 1985, abandoned, which is a continuation of Ser. No. 574,781, Jan. 27, 1984, abandoned.

[51] Int. Cl.[4] ..... B05B 15/10

[52] U.S. Cl. ..... 239/204; 137/59; 137/846; 239/571

[58] Field of Search ..... 239/570–572, 239/203–206; 137/846, 493.1, 493.9, 59

[56] References Cited

U.S. PATENT DOCUMENTS

| | | | |
|---|---|---|---|
| 2,292,373 | 8/1942 | Groeniger | 137/846 X |
| 3,159,176 | 12/1964 | Russel et al. | 137/493.1 |
| 3,556,122 | 1/1971 | Laerdal | 137/846 X |
| 3,575,347 | 4/1971 | Carlson | 239/206 X |
| 3,941,149 | 3/1976 | Mittleman | 137/493.1 |
| 4,432,495 | 2/1984 | Bruninga | 239/205 |

*Primary Examiner*—Andres Kashnikow
*Assistant Examiner*—Daniel R. Edelbrock
*Attorney, Agent, or Firm*—James W. Miller

[57] ABSTRACT

An improved sprinkler head (2) having a hollow housing (4) has a fluid inlet (5) for admitting water into housing (2). A drain valve (40) comprises an elongated flexible nipple (34) having an open upper end (35) and a closed lower end (36) having a normally closed drain passage (42). Nipple (34) is mounted in any drain port in housing (4). Whenever fluid pressures inside housing (4) increase above a first level, nipple (34) will have its walls bowed outwardly until the drain passage (42) is opened. Preferably, drain valve (40) is part of a check valve (30) which incorporates into it the structure of nipple (34).

1 Claim, 4 Drawing Figures

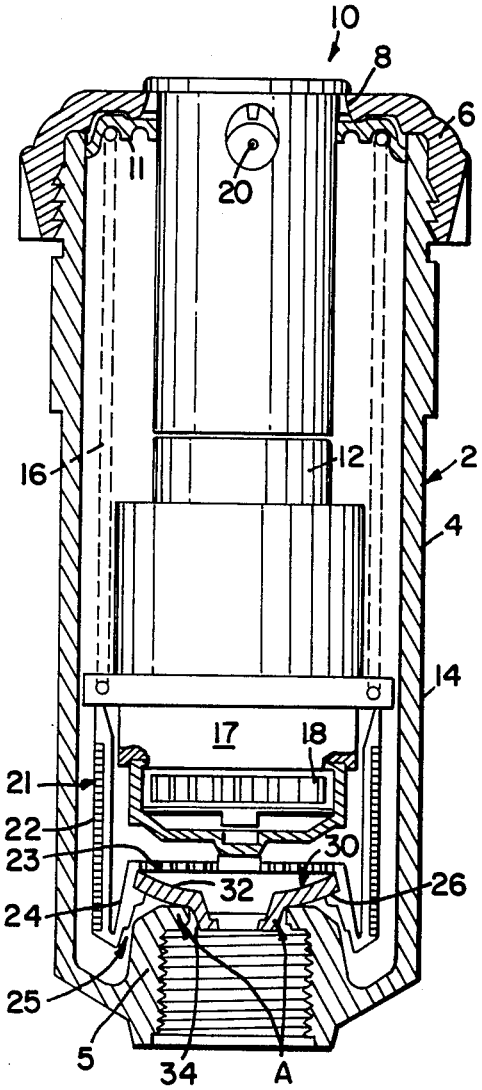
FIG. 1
FIG. 4
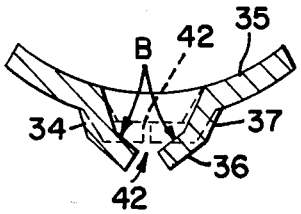
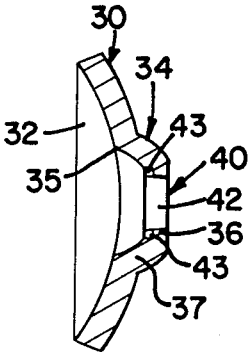
FIG. 3
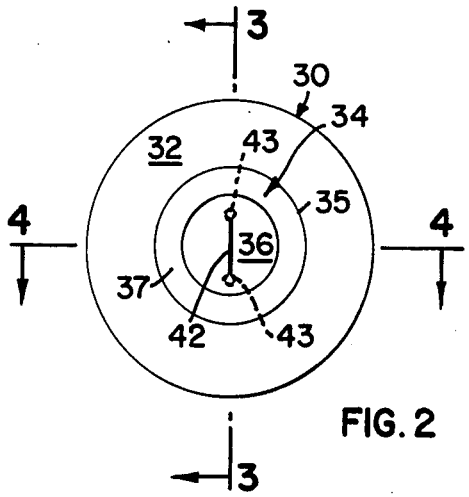
FIG. 2

SPRINKLER HEAD DRAIN VALVE

This application is a continuation of application Ser. No. 767,664, filed Aug. 21, 1985, which is itself a continuation of prior application Ser. No. 574,781, filed Jan. 27, 1984, both prior parent applications now being abandoned.

TECHNICAL FIELD

This invention relates to lawn sprinklers of the type commonly used in turf irrigation systems. More particularly, this invention relates to a drain valve for allowing water to drain out of the sprinkler head to prevent damage to the sprinkler head under freezing conditions.

BACKGROUND OF THE INVENTION

Underground lawn sprinkers are well known and typically comprise a hollow housing buried in the ground having a fluid inlet connected to a water supply line. The housing also includes a fluid outlet through which the water admitted to the housing is expelled. Various types of nozzles may be screwed onto or otherwise associated with the outlet for distributing this expelled water in any suitable pattern over a ground surface. Check valves have often been used with each of the sprinkler heads in an irrigation system to resist the static head pressures normally seen by the heads to prevent low head drainage. Some improved check valves are disclosed in U.S. Ser. Nos. 482,797 and 489,432, both now abandoned, assigned to The Toro Company, the assignee of the present application.

In northern climates where freezing temperatures are a problem during the winter, it is necessary to drain the irrigation system at the conclusion of the irrigation season to prevent damage to the system. This is often done by opening a drain valve at the low point in the system of water supply lines leading to the sprinkler heads. Sometimes, the draining operation is done by blowing compressed air through the water supply lines to blow out the water in the irrigation system through the sprinkler heads themselves.

When check valves are used with the sprinkler heads, the problem of draining water from the heads is complicated because the check valves open only one way and do not allow water to drain downwardly out of the valves and into the water supply lines. Thus, the method of draining which comprises simply opening a drain cock in the water supply lines is ineffective for removing any water in the head which is trapped or retained above the check valve. Moreover, even when the draining method comprises blowing compressed air through the lines, the sprinkler heads often have various cavities which serve to trap pockets of water which are retained in the head by the check valve even after the air is shut off. If this water is allowed to remain in the head over the winter, freezing will, of course, cause the water to expand and often cause damage to the sprinkler head, e.g. by forcing or blowing the top of the head off or otherwise doing damage to other of the internal parts of the head.

Applicants are aware of one type of prior art sprinkler head having means for draining water out of the housing downwardly through the fluid inlet. These heads, known as valve-in-head models (such as the Toro models 690-01 and 690-03), utilize a main valve comprising a cylindrical valve member that seals against the fluid inlet. This main valve has to be opened to allow water at the inlet to pass through the nozzles and otherwise cause the sprinkler head to operate. While this main valve is not a check valve per se, when closed it normally retains water in the sprinkler head. Thus, there is a need for draining water out of the housing of such a head.

In these prior art valve-in-head models, the water draining operation was accomplished by placing into the main valve a drain passageway extending through the main valve between the fluid inlet and the interior of the sprinkler head housing. This passageway terminated at its lower end in a drain port on the lower face of the main valve directly adjacent the fluid inlet. A cylindrical chamber defined by a screen was formed around the drain port on the lower face of the main valve. This chamber comprised a means for holding a ball and O-ring in close proximity to the drain port. Normally, water pressure at the inlet would keep the ball biased upwardly against the O-ring to close the drain port and prevent water from draining out of the sprinkler head housing. However, when water was exhausted out of the fluid inlet by opening a drain cock or the like in the water supply lines, the ball could fall by gravity away from the port and then allow any water remaining in the housing to drain down into the fluid inlet.

While the drain valve noted above is effective in accomplishing the desired result, it has a number of disadvantages. First, it utilizes a number of parts adding to the cost and complexity of the head, the parts namely being the O-ring, the ball, the chamber or some similar structure required for holding the ball and O-ring adjacent the drain port, and finally the drain port and the relatively extended passageway for connecting the fluid inlet and the interior of the housing through the main valve. Moreover, it is relatively difficult and time-consuming to assemble or construct such a drain valve into the main valve structure, especially because of the smallness of the ball and other parts. This further increases product cost.

SUMMARY OF THE INVENTION

Accordingly, one of the aspects of this invention is the provision of a simplified drain valve for a sprinkler head. Another aspect of this invention is such a simplified drain valve used in a sprinkler head having a check valve at the fluid inlet.

This invention relates to an improved sprinkler head of the type that includes a housing having an inlet for admitting water thereto and an outlet for expelling the water therefrom. The improvement of this invention comprises a drain means for the housing that includes a drain port that communicates between the interior and exterior of the housing. A drain valve comprises a hollow and flexible nipple having an open upper end secured adjacent the drain port and a closed lower end having a small drain passage. This drain passage is responsive to fluid pressure inside the housing to remain normally closed and to open when fluid pressures above a first level are encountered, e.g. pressures caused by freezing.

Another aspect of this invention is the provision of such an improved valve directly in a one piece flexible check valve so that a one piece unitary member forms both the check valve structure along with the drain valve. This is accomplished by forming a check valve of a one piece flexible member with the check valve having an outwardly extending nipple. The nipple is sized to be at least partially received in the fluid inlet. The check valve is normally in a first configuration sealing the fluid inlet but can be deformed to a second configuration in which it disengages the inlet. The drain valve passage is placed in the lower surface of the nipple and functions in the manner noted above.

BRIEF DESCRIPTION OF THE DRAWINGS

This invention will be described in more detail hereafter, when taken in conjunction with the following drawings, in which like reference numerals refer to like elements throughout.

FIG. 1 is a side elevational view, partly in cross-section, of an improved sprinkler head according to the present invention, particularly illustrating an embodiment in which the improved drain valve is part of the check valve of the sprinkler head;

FIG. 2 is a bottom plan view of the improved check valve/drain valve combination shown in FIG. 1;

FIG. 3 is a cross-sectional view of the improved check valve/drain valve combination taken along lines 3—3 in FIG. 2; and FIG. 4 is a cross-sectional view of the improved check valve/drain valve combination taken along lines 4—4 in FIG. 2, particularly illustrating both the open and closed positions of the drain valve.

DETAILED DESCRIPTION

Referring first to FIG. 1, an improved sprinkler head according to the present invention is generally illustrated as 2. Sprinkler head 2 as illustrated herein is a sprinkler head known as the Super 600®, manufactured by The Toro Company, the assignee of the present invention. Both sprinkler head 2 and an improved check valve 30 shown therein have been previously disclosed in co-pending U.S. application Ser. No. 482,797, filed April 7, 1983, now abandoned, and assigned to The Toro Company. The improved drain valve of the present invention has actually been incorporated as part of check valve 30 disclosed and claimed in the prior application. The reader hereof is referred to said application for a more complete explanation of the construction and operation of check valve 30. However, a brief description of sprinkler head 2 and check valve 30 sufficient to understand the present invention is included herein.

Sprinkler head 2 as shown herein is a pop-up sprinkler comprising a cylindrical housing 4 having a fluid inlet 5 at its bottom end. Fluid inlet 5 is internally threaded to mate with a threaded pipe coupling or fitting to couple housing 4 to a fluid supply line that is part of an irrigation system. The upper end of housing 4 is closed by a cap 6. Cap 6 will generally be flush with ground level when the sprinkler head is installed in situ in an irrigation system with housing 4 being buried underground. Cap 6 includes a central circular outlet opening 8 through which a riser 10 can extend and be guided thereby. Riser 10 is reciprocally mounted in housing 4 for up and down movement relative thereto. A seal 11 adjacent cap 6 seals against riser 10 for excluding debris from the interior of housing 4. Riser 10 is shown in a fully retracted position in FIG. 1.

Riser 10 includes a cylindrical body 12 having a circular flange 14 that forms a piston against which fluid pressure can act to cause riser 10 to "pop up". A return spring 16 surrounds riser body 12 and extends between the underside of seal 11 and flange 14 for normally forcing riser 10 down into its retracted position. The lower portion 17 of riser body 12, i.e. that part of riser body 12 below flange 14, includes a plurality of fluid ports (not shown) through which water can pass into the interior of riser body 12. There, the water is able to act on a turbine gear wheel 18 which is part of a drive transmission that rotates the upper portion of riser body 12, i.e. that portion of the riser body which contains the nozzle opening 20. After passing through the drive assembly, the water which has entered riser body 12 eventually exits through nozzle opening 20 to be distributed in any suitable stream or pattern over the ground surface.

A U-shaped screen 21 surrounds and encloses the lower portion 17 of riser body 12. Screen 21 comprises a hollow cylindrical section 22 having its bottom end enclosed by a bottom wall 23 of lesser diameter which wall 23 is located above the lowermost part of section 22. The wall 23 is connected to section 22 by a cone-shaped portion 24 which together with the wall defines a downwardly facing cavity 25 that normally receives within it fluid inlet 5 in close fit. Cavity 25 is bounded on its sides by the cone-shaped portion 24 which, in effect, forms a cone-shaped wall having an inner diameter that is accessible. An annular rib 26 is included on the inner diameter of this cone-shaped wall. Screen 21 is sized so that it can be press fit around the lower portion 17 of riser body 12 with the upper end being abutted against flange 14.

A check valve 30 comprises a one-piece unitary member made from a resilient material. Check valve 30 includes a circular, convexly shaped body 32 having an outwardly extending nipple 34 located at its center or apex thereof. Lip 26 defines a circular opening into which the check valve 30 can be installed by simply deforming body 32 and snap fitting the body above lip 26. When so installed, nipple 34 points downwardly toward fluid inlet 5. When riser 10 is in its fully retracted position, nipple 34 enters into and seals fluid inlet 5. Check valve 30 can be molded in one piece with the walls of the check valve having a relatively constant thickness. Preferably, the check valve is made from a rubber material known as Buna-N which has a durometer of 45 to 55 on the Shore D scale.

In any event, when riser 10 is fully retracted, nipple 34 and body 32 seal against and close fluid inlet 5. When it is desired to turn the sprinkler head 2 on and begin a sprinkling operation, an increase in fluid pressure is caused at the inlet 5 which will normally be resisted by check valve 30 to a certain point. This resistance is afforded by virtue of both the return spring 16 which exerts a downward force on check valve 30 and also by virtue of the convexly shaped body 32 and the resilient material of which check valve 30 is made which functions somewhat similarly to a spring. In any event, at some point as the fluid pressure at inlet 5 continues to increase, the pressure will be sufficient to deform the flexible check valve 30 from the first or closed configuration (shown in FIG. 1) to a second or flattened configuration (not shown) in which check valve 30 is lifted up off the fluid inlet so that the pressure seen at the inlet is now fully effective on flange 14 of riser 10 to begin moving the riser 10 up.

The foregoing has been provided as background for the present invention which relates to an improved drain valve 40 that, at least in the embodiment illustrated herein, is part of check valve 30. Referring to FIG. 3, the nipple 34 of check valve 30 can be considered as having an open upper end 35, a closed lower end 36, and an annular conical wall 37 connecting the upper and lower ends 35 and 36. The length of annular wall 37 defines the length of nipple 34 which length can obviously vary. In addition, the convexly shaped body 32 can also be considered as part of the open upper end 35 of nipple 34.

In any event, the improved drain valve 40 comprises in conjunction with nipple 34, a small drain passage in the form of a horizontal slit 42 placed in the flattened or planar lower end 36 of nipple 34. Slit 42 does not extend all the way to the sides of lower end 36, but is instead bounded by two small holes 43 at either end. Holes 43 do not extend all the way through the lower end 36 of nipple 34, as does slit 42, but only go about half way through the thickness of lower end 36. Holes 43 serve as means for preventing slit 42 from tearing all the way through lower end 36 of nipple 34. Normally, slit 42 is closed with the sides thereof being in direct engagement with one another. This is is accomplished by making the width of slit 42 very narrow, preferably simply by cutting a small slit 42 through lower end 36, and also because the annular wall 37 of nipple 34 is inwardly biased in the manner similar to a baby nipple or the like. This normal inward biasing of opposed portions of wall 37, brought about because of the use of rubber as the material of the nipple and also because of the way it is molded, serves to force the walls defining slit 42 more closely into engagement with one another.

Drain valve 40 of this invention remains closed whenever check valve 30 is operating in its normal manner as a check valve. For example, any fluid pressure at inlet 5 tends to close slit 42 because it will act on lower surface 36, and also on the exterior portions of annular wall 37 of nipple 34 as shown by the arrows A in FIG. 1, in a manner which tends to keep slit 42 closed. Thus, no water can seep from inlet 5 through drain valve 40 and into the interior of the housing.

Moreover, slit 42 will also remain closed during normal operation of sprinkler head 2 during the sprinkling season. For example, even when the interior of housing 4 is substantially filled with water, the inward biasing force 37 on the walls of nipple 34 will be strong enough to resist the static pressure of the column of water and keep drain slit 42 closed. However, at the conclusion of the sprinkling season, when it is desired to drain the system, water pressure is first removed from fluid inlet 5 by opening the drain cock or the like on the water supply line. Then, if water is still remaining in head 2, as is often the case, when freezing occurs the column of water in the head will start to freeze first at ground level with the ice progressively working its way downwardly. As this freezing process continues, an ever increasing fluid pressure is generated by the expanding ice column in the remaining column of water in head 2 until a large enough fluid pressure is seen inside nipple 34 causing the annular wall 37 of the nipple to bow outwardly as shown by the arrows B in FIG. 4, thereby opening drain slit 42. The open orientation of drain slit 42 is shown in solid lines in FIG. 4 while the normally closed orientation is shown in phantom. When this occurs, the remaining water in head 2 will spill down through the now opened drain slit 42 into fluid inlet 5.

It is not particularly important at what fluid pressures drain slit 42 opens as long as it opens at a pressure which is achieved before the entire interior of housing 4 is filled with ice. Drain valve 40 only has to drain enough of the water from the interior so that the entire housing 4 is not filled with ice which would lead to damage of sprinkler head 2. Any remaining ice in housing 4 will not cause any damage since there is still room left and will, upon the onset of warmer conditions, simply thaw.

Drain valve 40 according to this invention has numerous advantages. For example, it can be easily and simply placed into a unitary check valve having a nipple 34 simply by cutting a small slit 42 into the nipple. Such a valve is considerably less complex and costly than the prior art ball check valves known for the same purpose. Moreover, a ball check valve could not in and of itself have been placed into the flexible check valve 30 shown herein.

While drain valve 40 has been shown as part of check valve 30, the present invention would not require this. All that the present invention would require is the use of a flexible elongated nipple 34 having a drain slit 42 at the closed lower end 36 thereof with some means for mounting this nipple 34 in a port or opening in one of the walls of housing 4. Most of the time, the mounting could be achieved simply by gluing or otherwise securing the open upper end 35 of nipple 34 to the wall of the housing adjacent the drain port with the nipple extending out through the port. This, in effect, would make the nipple a sort of drain plug that would, when fluid pressures inside the housing are sufficiently high, open to expel fluid from the housing. However, when fluid pressures drop, the drain slit would close, thus being capable of resetting.

Various other modifications of this invention will be apparent to those skilled in the art. Thus, the scope of this invention should be limited only by the appended claims.

We claim:

1. An improved sprinkler head of the type that includes a hollow cylindrical housing having upper and lower ends, wherein the lower end of the housing has a fluid inlet, a cylindrical riser reciprocally contained within the housing above the fluid inlet, wherein the riser has a lower portion that includes means for admitting fluid into the interior thereof and an upper portion that includes a nozzle for expelling the fluid therefrom, wherein the riser is movable when fluid under pressure enters the housing from a first position where it is retracted within the housing to a second position where the nozzle is located above the upper end of the housing to cause fluid to be sprinkled outside the housing, wherein the lower portion of the riser in its retracted position is closely adjacent the fluid inlet, and a check valve associated with the inlet for preventing fluid from passing into the housing until the fluid pressure at the inlet exceeds a predetermined minimum; wherein the improvement relates to the check valve and comprises:

(a) a flexible one-piece check valve for sealing against the fluid inlet, wherein the check valve comprises a circular, convexly shaped body secured to the lower portion of the riser, wherein the body has a hollow nipple located at the center thereof outside the curve of the convexly shaped body and extending downwardly away therefrom toward the fluid inlet and away from the lower portion of the riser, the nipple terminating in a substantially horizontal and flat planar lower end, wherein the body and nipple are respectively defined by first and second annular walls integrally joined together with both walls approximately the same thickness, wherein the convexly shaped body of the check valve has a first configuration in which the nipple is received inside and seals against the inlet, and wherein the first annular wall that defines the convexly shaped body of the check valve is deformable from the first configuration to a second configuration under the influence of fluid pressure at the inlet above the predetermined minimum to disengage the nipple from the inlet and allow water to enter the housing: and (b) wherein the check valve includes a fluid pressure responsive means thereon for draining water from the interior of the housing back into the inlet when water pressure above a first level are experienced inside the housing, wherein the fluid pressure responsive means includes a slit placed in the planar lower end of the nipple, and wherein the second annular wall defining the nipple has opposed portions thereof biased inwardly with a sufficient force such that the slit is normally closed by the inward biasing of the second annular wall but is opened by water pressure inside the housing higher than the first level which higher pressure causes the second annular wall to flex and open the slit.

* * * * *